US007004322B1

(12) United States Patent
Bartoli

(10) Patent No.: US 7,004,322 B1
(45) Date of Patent: Feb. 28, 2006

(54) PACKAGING UNIT

(75) Inventor: Andrea Bartoli, Reggio Emilia (IT)

(73) Assignee: Unifill International AG, Kreuzlingen (CH)

( * ) Notice: Subject to any disclaimer, the term of this patent is extended or adjusted under 35 U.S.C. 154(b) by 0 days.

(21) Appl. No.: 09/202,338

(22) PCT Filed: Jun. 16, 1997

(86) PCT No.: PCT/EP97/03100

§ 371 (c)(1),
(2), (4) Date: Jul. 18, 2000

(87) PCT Pub. No.: WO97/48619

PCT Pub. Date: Dec. 24, 1997

(30) Foreign Application Priority Data

Jun. 18, 1996 (IT) ..... MO96A0080

(51) Int. Cl.
*B65D 73/00* (2006.01)

(52) U.S. Cl. ..... 206/484; 222/107

(58) Field of Classification Search ..... 206/219, 206/222, 484, 461, 467, 469, 470; 222/107, 222/212; D24/118

See application file for complete search history.

(56) References Cited

U.S. PATENT DOCUMENTS

| | | | | | |
|---|---|---|---|---|---|
| 3,224,640 | A | * | 12/1965 | Schneider et al. | 222/107 |
| 3,913,734 | A | * | 10/1975 | Sigel | 206/470 |
| 4,209,096 | A | * | 6/1980 | Carkhuff | 206/469 |
| 5,529,224 | A | * | 6/1996 | Chan et al. | 222/212 |
| 5,839,609 | A | * | 11/1998 | Zakensberg | 222/107 |
| 6,085,942 | A | * | 7/2000 | Redmond | 222/107 |
| 6,348,246 | B1 | * | 2/2002 | Finestone et al. | 428/34.3 |
| 6,557,731 | B1 | * | 5/2003 | Lyon et al. | 222/94 |

* cited by examiner

*Primary Examiner*—Shian T. Luong
(74) *Attorney, Agent, or Firm*—Reising, Ethington, Barnes, Kisselle, P.C.

(57) ABSTRACT

Packaging unit (1) for a flowable product, comprising first and accord walls (2, 3) at least one (3) of which is concave and which are sealingly joined along their respective edges and define therebetween a cavity containing the flowable product, at least one of the walls (2, 3) being provided with a severing indication (8), severing along a line indicated by the severing indication (8) and extending from side-to-side across the packaging unit (1) opening a product outlet portion (6) of the cavity; the severing indication (8) has over at least one of two end zones thereof at respective opposite sides (9) of the unit (1) a curvedly convex profile projecting away from the cavity.

9 Claims, 3 Drawing Sheets

Fig.1
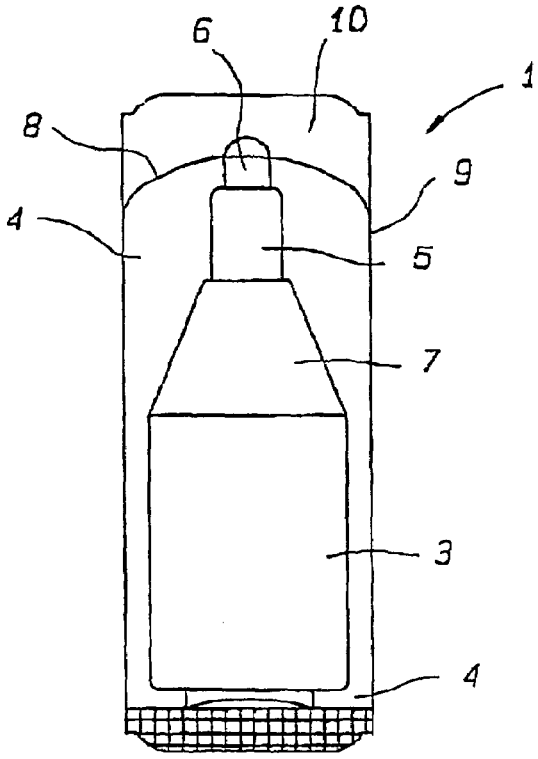
Fig.2
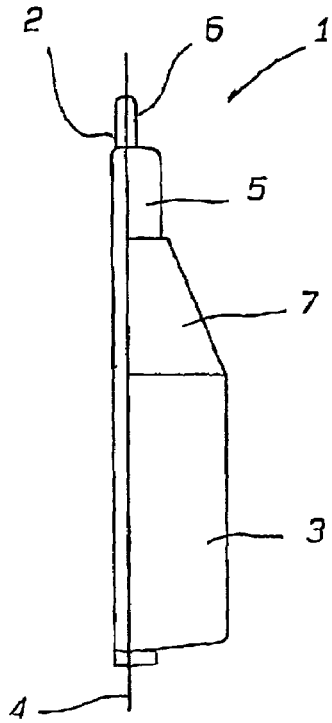
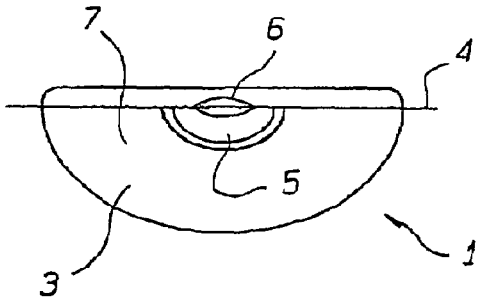
Fig.3

PACKAGING UNIT

Applicant claims the benefit of Italian Patent Application MO96A000080 filed in Italy on Jun. 18, 1996 under the provisions 35 U.S.C. § 119.

The invention concerns a packaging unit for a flowable product.

The prior art comprises a container obtained from a pair of shells welded along respective edges and defining between them a cavity containing a flowable product. For the discharge of the product, such containers are transversely equipped with a predetermined fracture line whereby it is easy to open the container by application of a limited force to separate an end portion of the container from the body of the same. The predetermined fracture line extends across a tubular appendix of the cavity of the container and thus, when the container is broken there, opening of the appendix takes place through which the product can be expelled from the cavity by manual squashing of the shells.

In those containers, when the container is open, between the edge resulting from the breaking along the fracture line and respective opposite lateral edges of the container there are left sharp corners which can be dangerous for the consumer, being sharp and thus liable to cause excoriations or scratches. A container of this kind is disclosed in, for example, NL-B-167681.

Thus, such containers, which, because of their low cost, are, for example, generally used for packaging or single-dose disposable and free-of-charge samples, are not used for storing food products, or medicaments, because of their potential harm to consumers.

An object of the invention is to reduce considerably the danger of the above-mentioned containers, particularly to avoid harm to the consumer when they are open and a food product, or a medicament, is eaten or drunk therefrom.

According to the present invention, there is provided a packaging unit for a flowable product, comprising first and second walls at least one of which is concave and which are sealingly joined along their respective edges and define therebetween a cavity containing the flowable product, at least one of said walls being provided with a severing indicating means, severing along a line indicated by said severing indicating means and extending from side-to-side across the packaging unit opening a product outlet portion of said cavity, characterized in that said severing indicating means has over at least one of two end zones thereof at respective opposite sides of said unit a curvedly convex profile projecting away from said cavity.

Owing to the invention, it is possible to avoid the formation of sharp corners when opening the packaging unit, so that the packaging unit can be used for a medicament, or a food product, which are consumed directly from the packaging unit, without risk of harm to the consumer.

The severing indicating means may take the form of a mark, for example a printed line, which the consumer is intended to follow in cutting open the packaging unit to reveal the product outlet portion; however, the severing indicating means is preferably in the form of a weakness whereby the consumer can tear or break off an end portion of the packaging unit to reveal the product outlet portion.

The profile of the severing indicating means may be convexly curved From side-to-side of the unit, or may have a substantially rectilinear middle zone.

Avantageously, the packaging unit comprises two walls, at least one of which is concave, sealingly, joined along respective edges and defining a cavity containing a flowable product, the cavity being provided with an incision extending from side-to-side across the unit and thereby across a product outlet portion of the cavity, characterized in that the predetermined fracture line has a convex profile projecting away from the cavity.

The invention will be better understood and carried into practice by reference to the accompanying drawings, showing some embodiments of the invention, wherein:

FIG. 1 is a front view of a packaging unit;

FIG. 2 is a side view of the unit;

FIG. 3 is a top view of the unit;

Figure 4:
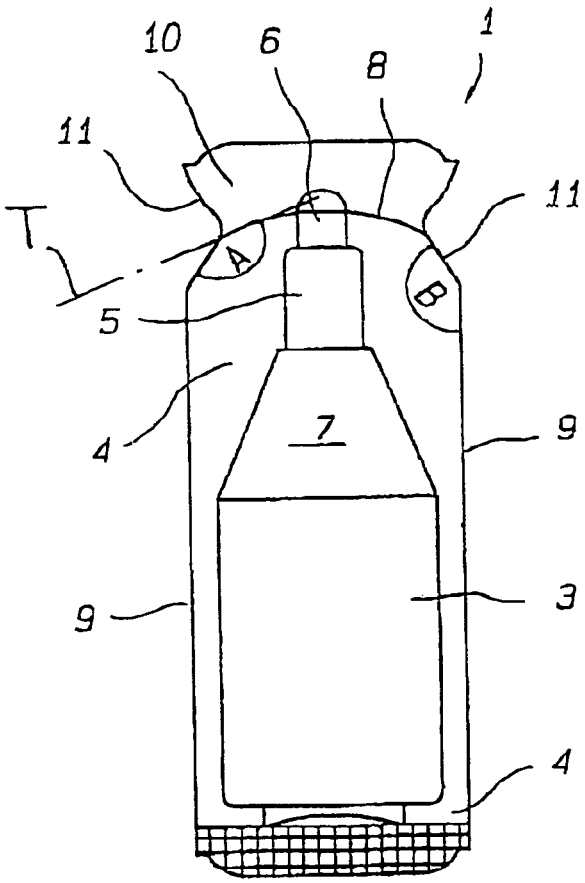
FIG. 4 is a front view as in FIG. 1, but of another embodiment.

Referring to FIGS. 1 to 3, a packaging unit 1 is in the form of a substantially flat, first sheet 2 and a concave second sheet 3 joined along a peripheral weld 4 defining the edge of the unit, the unit having been produced by blow-thermoforming. The sheets 2 and 3 define a cavity including a tubular recess 6, bounded by the weld 4 on three sides; the cavity also includes a conduit 5 exiting into the recess 6 at one end and a funnel-shaped duct 7 leading to the conduit 5 from a main part of the cavity.

The recess 6 has transverse dimensions considerably less than the transverse dimensions of the conduit 5 which are, in turn, considerably less than the transverse dimensions of the main part of the cavity.

As a consequence, the weld 4 may be of increasing width from the main part of the cavity to the recess 6.

Referring to FIG. 3, the recess 6 can have a lenticular transverse cross-section in order to act as a valve capable of obstructing accidental emission of the product and thus allowing exiting of the product only when the walls of the cavity are subjected to squashing.

The recess 6 is transversely provided with a predetermined fracture line 8 extending sideways for all of the widths of corresponding opposite portions of the weld 4 and having a convexly curved profile substantially merging with corresponding lateral edges 9 of the unit 1.

Therefore, when a consumer wishes to eat or drink the product, or to take a medicine packaged in the unit, he can simply tear off a removable portion 10 of the weld 4, so obtaining an open container without sharp corners.

Figure 5:
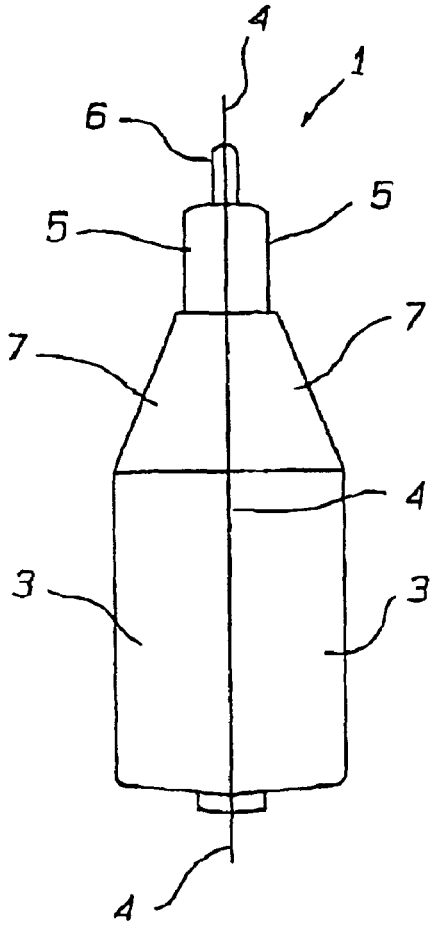
FIG. 5 is a side view of that other embodiment.

The embodiment shown in FIGS. 4 and 5 consists of oppositely disposed, symmetrical shells 3 and has its lateral edges 9 provided with recesses 11 to facilitate opening. As shown in FIG. 4, the predetermined fracture line 8 is combined with the bases of the recesses 11, so as to define a significantly obtuse angle A between the curved end zone of the line 8 and one side of the recess 11, at each side of the cavity (the reference A actually indicates the angle between the tangent T to an end of the fracture line 8 and the side of the recess 11). The reference B indicates a significantly obtuse angle between an edge 9 and an adjacent side of the recess 11.

The angles A, B are sufficient (preferably at least 135°, for example approximately 150°) to avoid the open container harming the consumer.

Figure 7:
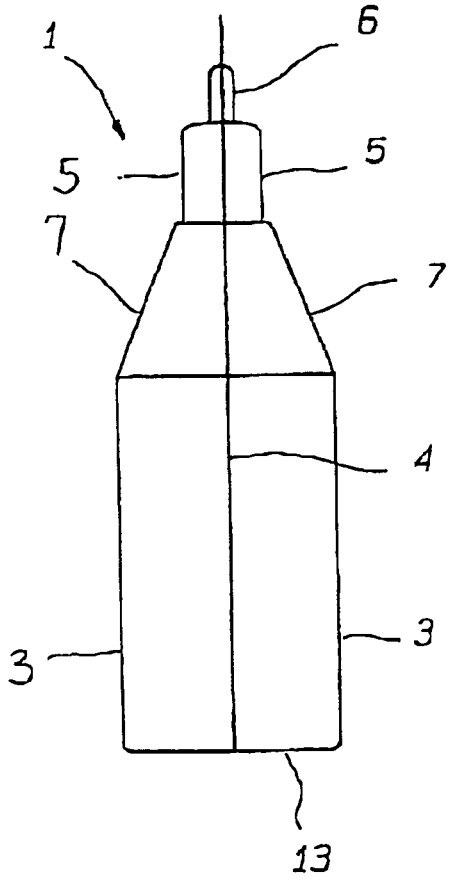
FIG. 7 is a view similar to FIG. 6, but of a yet further embodiment.
Figure 6:
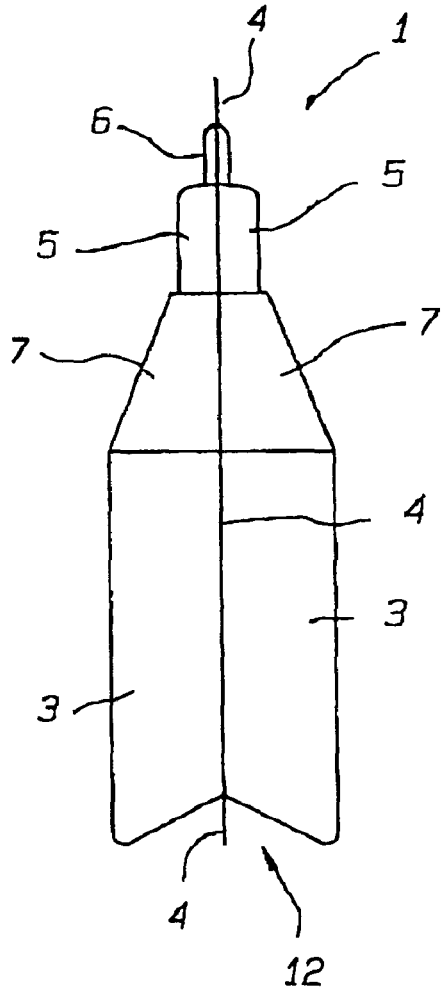
FIG. 6 is a view similar to FIG. 5, but of a further embodiment.

As shown in FIGS. 6 and 7, the packaging unit can be of a stand-up character, with a concave bottom 12, or with a flat bottom 13.

The packaging unit 1 can be obtained by, for example, blow- thermoforming as described in WO94/08852.

Furthermore, the predetermined fracture line 8 may be obtained by an incision punch, with incision means shaped substantially according to the profile of the fracture line. The external profile of the weld 4, including the recesses 11, if any, can be made of any suitable shape by means of shaped cutting punches.

What is claimed is:

1. Packaging unit (1) for a flowable product, comprising first and second walls (2, 3) at least one (3) of which is concave and which are sealingly joined along their respective edges and define therebetween a cavity containing the flowable product, at least one of said walls (2, 3) being provided with a severing indicating means (8) for severing along a line indicated by said severing indicating means (8) and extending from side-to-side across the packaging unit (1) for opening a product outlet portion (6) of said cavity, characterized in that said severing indicating means (8) has over at least one of two end zones thereof at respective opposite sides (9) of said unit (1) a curvedly convex profile projecting away from said cavity.

2. Packaging unit according to claim 1, wherein said indicating means (8) comprises an incision (8) defining a predetermined fracture line.

3. Packaging unit according to claim 1 or 2, wherein said indicating means (8) has a curvedly convex profile from one of said sides (9) to the other of said sides (9).

4. Packaging unit according to claim 1 or 2, wherein said indicating means (8) has a rectilinear middle zone.

5. Packaging unit according to claim 2, wherein at at least one end of said indicating means (8) is a recess (11) in said respective edges and to the base of which said indicating means (8) extends.

6. Packaging unit according to claim 5, wherein the or each recess (11) has a substantially rectilinear boundary portion defining, together with said indicating means (8), a significantly obtuse angle.

7. A packaging unit (1) for a flowable product, comprising first and second walls (2, 3) at least one (3) of which is concave and which are sealingly joined along their respective edges and define therebetween a cavity containing the flowable product, at least one of the walls (2, 3) being provided with a severing indicating means (8) for severing along a line indicated by the severing indicating means (8) and extending from side-to-side across the packaging unit (1) for opening a product outlet portion (6) of the cavity, characterized in that the severing indicating means (8) has over at least one of two end zones thereof at respective opposite sides (9) of the unit (1) a curvedly convex profile projecting away from the cavity, the indicating means (8) comprises an incision (8) defining a predetermined fracture line, that at least one end of said indicating means (8) is a recess (11) in said respective edges and to a base of which said indicating means (8) extends, and the recess (11) has a substantially rectilinear boundary portion defining, together with said indicating means (8), a significantly obtuse angle.

8. The packaging unit according to claim 7 wherein the indicating means (8) has a curvedly convex profile from one of said sides (9) to the other of said sides (9).

9. The packaging unit of claim 7 wherein the indicating means (8) has a rectilinear middle zone.

* * * * *